US006352070B1

(12) United States Patent
Mendoza-Orozco

(10) Patent No.: US 6,352,070 B1
(45) Date of Patent: Mar. 5, 2002

(54) SAFETY FOR SPORTING PELLET OR AIR RIFLES

(76) Inventor: Hector Mendoza-Orozco, Prolongacion Constitucion No. 57 Colonia Santiago Tepalcatlalpan, 16210 Xochimilco Distrito Federal (MX)

( * ) Notice: Subject to any disclaimer, the term of this patent is extended or adjusted under 35 U.S.C. 154(b) by 0 days.

(21) Appl. No.: 09/492,399

(22) Filed: Jan. 27, 2000

(30) Foreign Application Priority Data

Oct. 27, 1999 (MX) ..... 99300

(51) Int. Cl.[7] ..... F41A 19/06; F41A 19/00; F41A 17/46; F41A 17/62; F41A 17/00

(52) U.S. Cl. ..... 124/37; 124/40; 124/66

(58) Field of Search ..... 124/65, 66, 37, 124/40

(56) References Cited

U.S. PATENT DOCUMENTS 1,164,646 A * 12/1915 Heyman et al. ..... 124/66
1,509,257 A * 9/1924 Randall ..... 124/67
2,729,208 A * 1/1956 Gaeke ..... 124/66
2,837,865 A * 6/1958 Wells ..... 446/192
3,465,741 A * 9/1969 Daniel et al. ..... 124/55
3,839,999 A * 10/1974 Fleming et al. ..... 124/66
5,596,976 A * 1/1997 Waiser ..... 124/25
5,666,753 A * 9/1997 Kolling ..... 42/70.01
5,941,005 A * 8/1999 Battaglia et al. ..... 42/70.08
6,223,460 B1 * 5/2001 Schmitter et al. ..... 42/70.06

* cited by examiner

*Primary Examiner*—Charles T. Jordan
*Assistant Examiner*—John W. Zerr
(74) *Attorney, Agent, or Firm*—Harrison & Egbert

(57) ABSTRACT

The present invention is a safety formed in a sporting pellet or air rifle which prevents the accidental firing of the rifle even when it is loaded. The safety utilizes a loading pull lever, a crescent-shaped portion positioned generally at the middle of the loading pull lever, a pusher located at an end of the loading pull lever, a piston positioned within the barrel of the rifle so as to be cooperative with the pusher, a piston stopper connected to an end of the piston, a hand-activated safety, a safety base supporting the stem of the safety, a trigger having a particular shape for cooperation with the safety, and a retaining lever which is movable so as to touch the piston stopper and is movable downwardly to secure the rod of the piston. The lever is positioned in front of the trigger so as to prevent the firing of the rifle before the pull lever has been fully depressed. The crescent-shaped portion of the pull lever is rotatable during the loading action so as to obstruct the trigger from engagement by the fingers of the user.

3 Claims, 7 Drawing Sheets

SAFETY FOR SPORTING PELLET OR AIR RIFLES

BACKGROUND OF THE INVENTION

1. Field of the Invention

The present invention relates to safeties that are incorporated into pellet or air rifles of the type which prevents the accidental firing of the rifle even when it is loaded. More particularly, the present invention relates to safeties which must be removed in order to fire a shot from the rifle. Additionally, the present invention relates to safeties that have a loading pull lever that is geometrically modified so that at the time of starting to load the rifle, it is impossible to introduce a finger anywhere near the trigger since the lever is placed in front of the trigger so as to prevent the firing of the rifle until the pull lever has been fully depressed.

2. Description of Related Art

Sporting pellet rifles are regularly used to introduce young and teenage boys to the sport of target shooting. This type of rifle is produced with a mechanism which has a piston to compress air. The mechanism is recharged by means of a pull lever placed underneath the rifle and generally close to where the trigger is located.

There are several instances in the past in which the lack of knowledge or ignorance of the rifle's firing mechanism has caused minor accidents to the user, particularly these affecting the fingers and the hands. This is due to the confidence of the user and due to attempts to investigate what has happened when the rifle is in a different position than normal.

In order to avoid this problem, several inventions have been developed in the past. These inventions include modifications in the way in which the rifle is reloaded, such as by significantly altering the design of the reloader by placing it on the top of the rifle. However, for the sporting pellet and air rifles in which the loading lever is located underneath the trigger, no improvement has been made to allow it to be safe.

Improved safeties for sporting pellet or air rifles are described in various U.S. patents, such as U.S. Pat. Nos. 1,164,646, 1,509,257, 3,465,741, 3,839,999, 5,596,976 and 5,666,753. These patents include safety mechanisms with automatic safety means which lock crossbow triggers so as to prevent unintentional shooting. None of these patents relate to the structure of the present invention.

BRIEF SUMMARY OF THE INVENTION

It is an object of the present invention to have a manual safety placed on a sporting pellet rifle which prevents the firing of the gun even when it is loaded.

Another objective of this invention is to provide a modified loading pull lever which prevents the placement of a finger on the trigger before it is totally depressed.

Another object of the present invention is to prevent an accident to the user when moving the loading pull lever by preventing such user from placing his or her fingers on the trigger even when the gun is prepared for firing.

Another object of the present invention is to provide a sporting pellet rifle which possesses safety mechanisms which minimize any chance of accident due to improper handling.

Another object of the present invention is to provide a sporting pellet rifle which complies with safety standards and rules of various governmental authorities.

Another object of the present invention is to provide a gun which remains safe even when the pull lever is moved to its stop.

BRIEF DESCRIPTION OF THE SEVERAL VIEWS OF THE DRAWINGS

The characteristic details of this safeties for sporting pellet or air rifles is clearly shown in the following description and in the attached drawings.

DETAILED DESCRIPTION OF THE INVENTION

Figure 1:
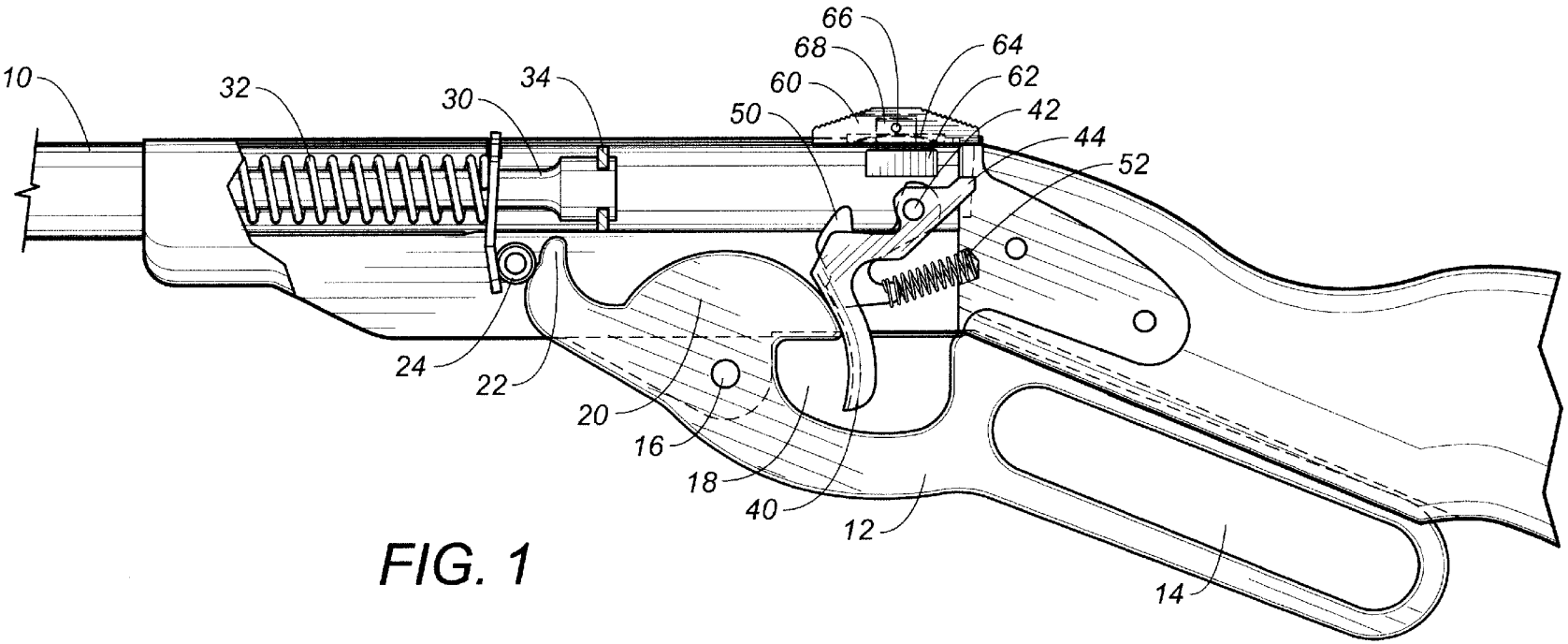
FIG. 1 is an elevational view of the sporting rifle mechanism, in an unloaded position.

Referring to the aforementioned figures, the present invention is formed by a conventional rifle with a barrel at the front and a butt at the back The butt is used as a support when firing. The firing mechanism is located in the middle. The firing mechanism includes a combination of an elongated loading pull lever 12, which has an eyelet 14 at the back thereof. The eyelet 14 sticks out therefrom and is inserted in a channel located at the bottom of the butt at the normal resting position. The loading pull lever is used to hold onto and to start the loading operation of the rifle 10. The lever 12 is supported about the middle thereof by an axial bolt 16 during the loading of the shot. The lever is rotated about the axial bolt 16. At the same time, the lever 12 has a second eyelet 18 located beneath the trigger 40. This arrangement allows the introduction of the finger for the purpose of firing a shot. A crescent-shaped portion 20 is integral with the lever 12 and is formed above the axial bolt 16. The crescent-shaped portion 20 is arranged so that when the lever 12 is rotated to prepare the shot, the crescent-shaped portion 20 will cover the trigger 40. As a result, it prevents the undue introduction of a finger when loading the gun. Even when the rifle is loaded, it does not allow a shot to be fired even when the lever 12 is placed in an open position or in a position different to the normal resting position. The lever 12 has pusher 22 projecting toward the end thereof. The pusher 22 has a hook shape which is used to guide and to push the piston 30. The pusher has a small spring holding lever located at the back thereof which rests on a latch 24 formed by a bolt mounted on the inside of the casing of the rifle 10. The bolt has the function of closing and securing the loading lever 12.

The piston 30 is located within the rifle's barrel 10. The piston 30 is a cylindrically-shaped piece having an inner groove (not shown) along which the pusher 22 moves and rotates. The piston 30 has a spring 32 wrapped around the rod extending from the piston. The spring 32 can be compressed when the gun is prepared for shooting. This compression corresponds to the situation in which the piston 30 is pulled backwardly. The end of the piston 30 has a gasket (not shown) while the other end of the piston includes a plate 34, hereinafter called a piston stopper. The piston stopper includes a small rectangular plate joined at the end of the piston 30. The function of the piston stopper is to push through the movement of the pusher 22, firstly a retaining lever 30 as well as a base 62 of the safety 60.

The safety 60 is a bulky button in the form of a trapezium with grooves on its surface to hold and to move the safety 60 manually. The button is placed on the outside of the gun on a side on which the sight of the gun is usually situated. The safety 60 can only be moved in one direction before returning to its initial position. The bottom part of the safety 60 has a rectangular-shaped hole where a spring 64 is located. The safety 60 has a greater depth in the center thereof. This greater depth is oval-shaped. The spring 64 is a small rectangular plate with an oval hole in the center thereof which corresponds to the oval-shaped hole in the safety 60. The spring 64 is a leaf spring which has a curve so as to act with a flexing movement. The spring 64 carries out the function of pressing the safety 60 and keeping it in a compressed position while remaining fixed. A hole is located within the gun into which the base of the safety 62 is introduced. The base of the safety is formed by one rectangular-shaped piece whose front end is in front of the stopper plate 34 of the piston. The stem of the safety 68 sticks out from the base 62 of the safety. This stem is formed by a shank having an oval base. This stem corresponds to the hole in the spring 64 through which it passes and is introduced into the hole in the safety 60. The safety 60 has a side hole through which a pin 66 is placed in order to assemble the pieces together.

The trigger 40 is formed from a channel-shaped plate. The trigger 40 has a slightly curved and elongated portion. This slightly curved and elongated portion forms the portion of the trigger upon which the user supports his or her finger in order to fire the rifle. The trigger has a L-shaped portion which extends inside the firing mechanism. This L-shaped portion is held in place by a pin 42. The trigger also has a second elongated portion whose ends form the support legs of the safety 44. Therefore, once the rifle 10 is loaded and the safety 60 is operated, support legs 44 are placed beneath the base of the safety 62. As a result, the trigger cannot be operated and the gun cannot be fired.

The retaining lever 50 is a U-shaped plate with a hole at one end. The retaining lever 50 is placed inside the channel of the trigger 40 and is secured by using the pin 42. The other end of the retaining lever 50 has a spring 52 mounted on it which allows the lever to move inwardly in such a way that one point is uncovered and touches the plate 34 or the piston stopper so as to move downwardly to then return the rod of the piston 30 in the same manner as a door lock.

Operation of the rifle in accordance with the present invention shown in the series of drawings of FIGS. 1–5. In FIG. 1, it can be seen that the rifle 10 is unloaded. The piston is moved toward the front and all the other pieces of the rifle 10 are at rest.

Figure 2:
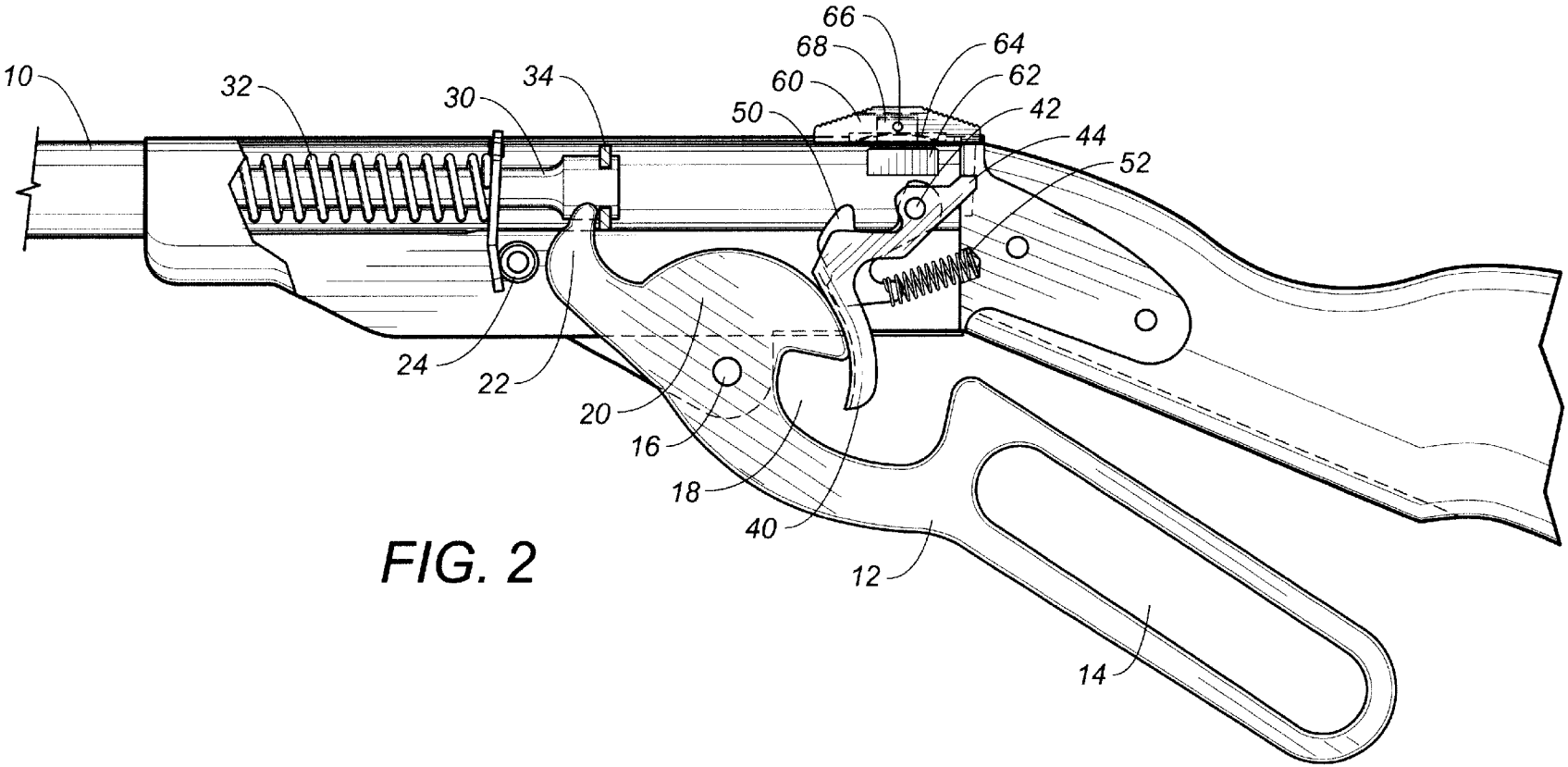
FIGS. 2–4 show views of the rifle in a sequence of movement of the loading pull lever. These figures highlight the initial operations in FIG. 2, the loading action with the movement of the piston in FIG. 3, and the loading completion with the total movement of the piston and the placement of the trigger safety in FIG. 4.

In FIG. 2, the loading operation of the rifle is shown. The loading begins by articulating the lever 12 so that the pusher 22 is introduced into the groove on the piston such that the pusher hits; the plate of the piston stopper 34. The spring 32, which surrounds the rod of the piston, will begin to compress. At the same time, the crescent-shaped portion 20 of the lever 12 is placed over the trigger 40 so as to prevent the user's fingers from being introduced.

Figure 3:
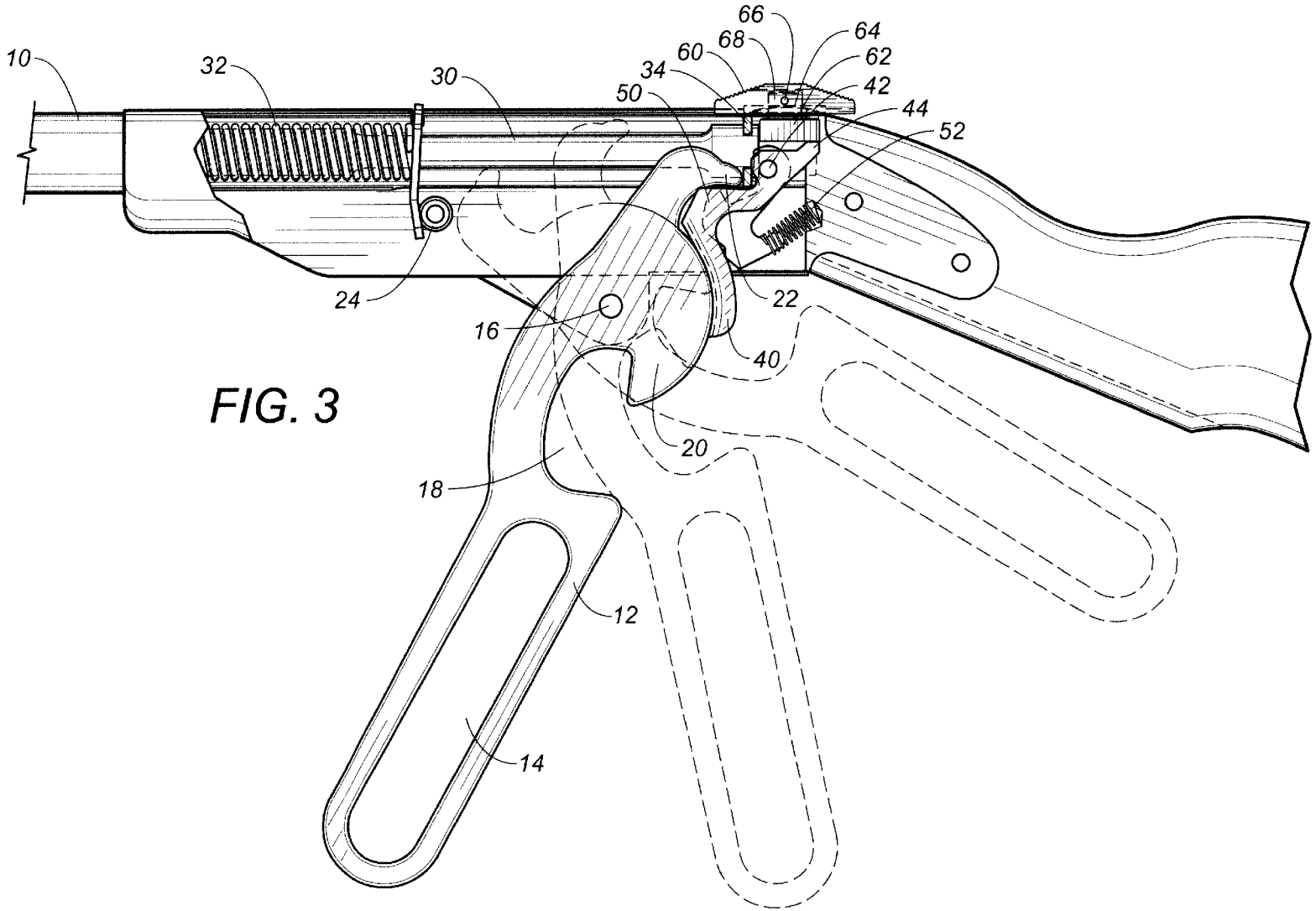

In FIG. 3, the loading action is completed. This loading action is completed when the plate 34, moved by the pusher 22, jumps the retaining lever 50 with which the spring 52 operates in order to return the rod of the piston in the manner like a door lock. The plate 34 touches the base of the safety 62 so as to cause a backward movement thereof. The safety is then activated. At the same time, the hook-shaped portion of the pusher 22 slightly moves the trigger 40. As a result, the elongated portions that form the supporting legs of the safety 44 will be arranged below the base of the safety 62 so as to prevent the trigger from being operated and, as a result, the rifle cannot be fired.

Figure 4:
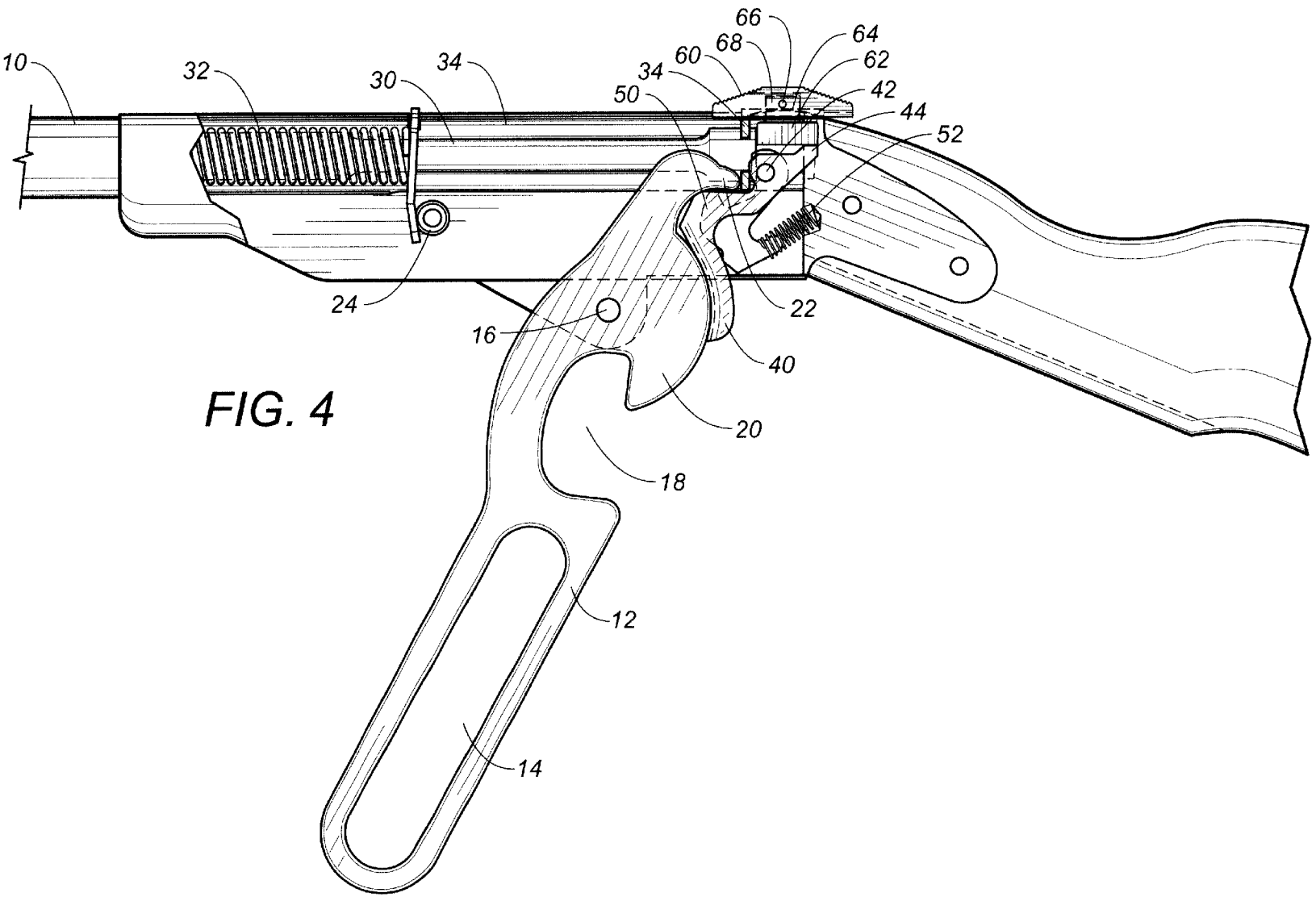

FIG. 4 shows the completion of the loading action in which the lever 12 returns to its original position. This leaves the piston spring 32 compressed and the piston 30 slightly moved toward the front.

Figure 5:
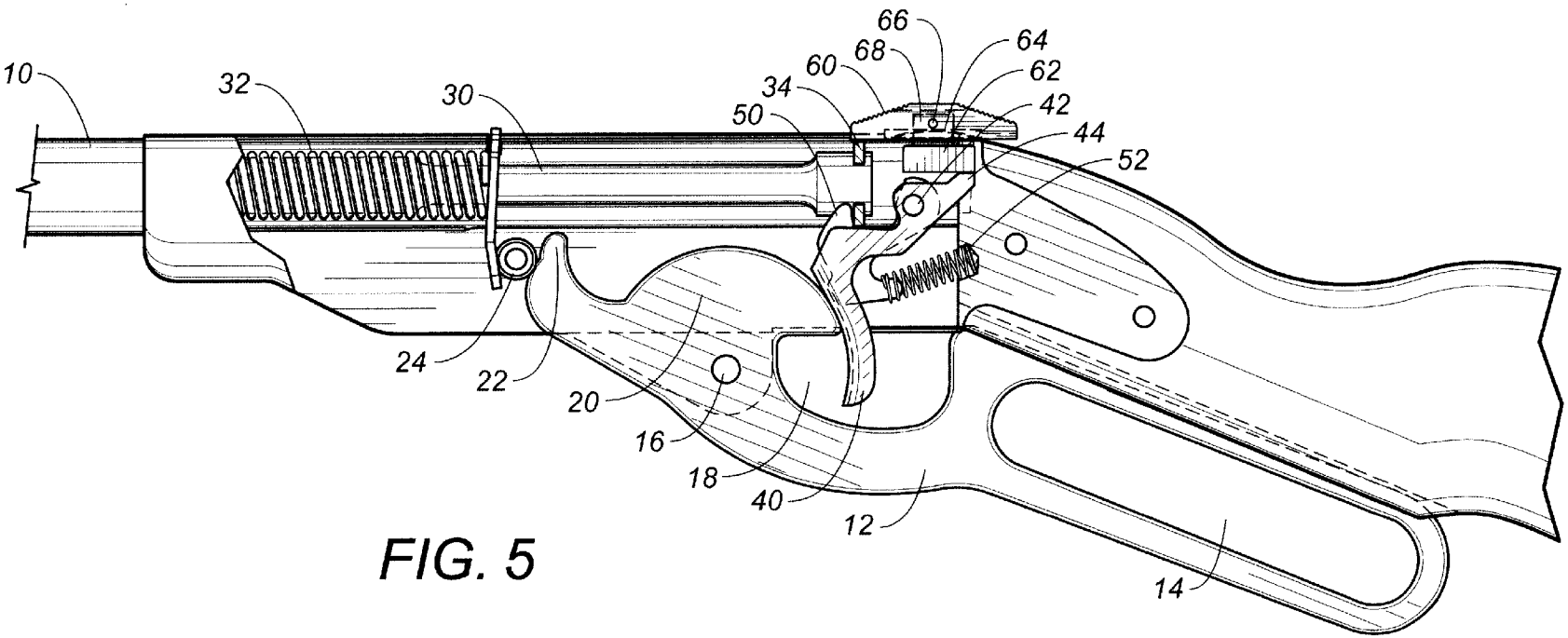
FIG. 5 is another cross-sectional view of the rifle showing the position of the loaded rifle in a position ready to fire a shot.
Figure 7:
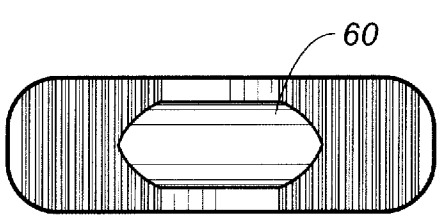
FIGS. 6–10 are vertical cross-section, plan, side elevational, front elevational and conventional perspective views, respectively, of the safety carrier.
Figure 6:
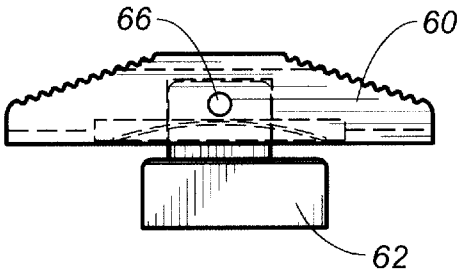
Figure 10:
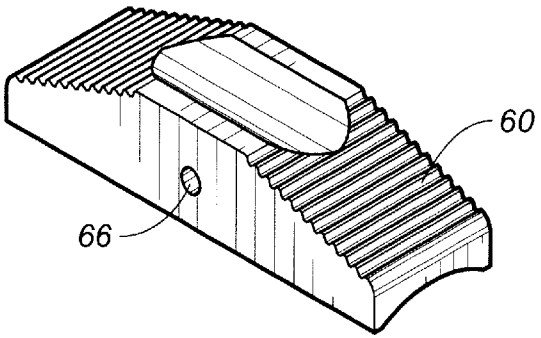
Figure 9:
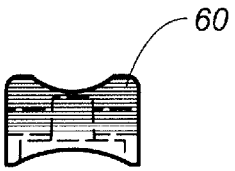
Figure 8:
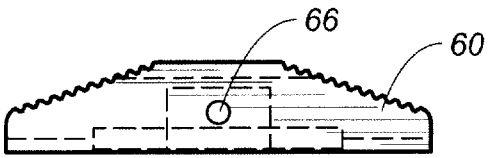
Figure 11:
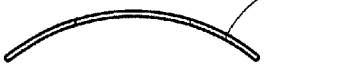
FIGS. 11 and 12 are elevational and plan views, respectively, of the safety spring.
Figure 12:
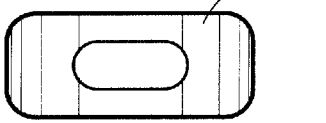
Figure 13:
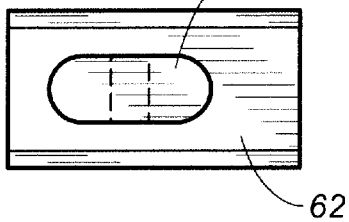
FIGS. 13–15 are plan views and elevational views of the base of the safety.
Figure 14:
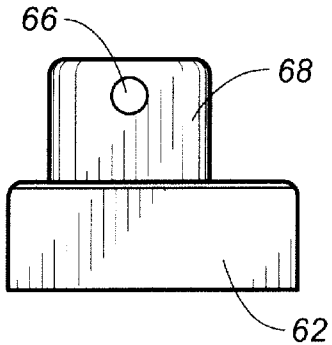
Figure 15:
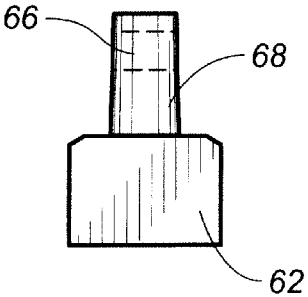

FIG. 5 shows that the lever 12 has reached its original position. The retaining lever of the crescent-shaped portion located toward the back of the pusher 22 is in line with the latch 24. This produces a slight sound. As a result, it will mean that the lever 12 is ready for firing.

In order to be able to fire the gun, the safety 60 must be pushed forward. The supporting legs of the safety 44, positioned beneath the safety base 62, will then be released. By pressing on the trigger 40, the piston 30 will move forward so as to fire a pellet. The spring 32 will once again unravel, in the manner shown in FIG. 1. While the safety 60 is activated, the gun cannot be fired by any means, even by trying to pull the trigger 40. The gun cannot be fired if the lever 12 is moved from its position, even when the rifle is loaded since the crescent-shaped portion 20 will be in position so as to obstruct the trigger 40 in a position in front of the trigger 40.

The foregoing disclosure and description of the invention is illustrative and explanatory thereof. Various changes in the details of the illustrated construction can be made within the scope of the present invention without departing from the true spirit of the invention. The present invention should be limited by the following claims and their legal equivalents.

What is claimed is:

1. A rifle having an improved safety comprising:

a barrel;

a butt located rearwardly of said barrel;

a firing mechanism with a trigger positioned generally between said barrel and said butt;

a loading pull lever formed of an elongate piece, said pull lever having a first eyelet sticking out therefrom, said first eyelet being received in a channel positioned at a bottom of said butt, said loading pull lever suitable for beginning a loading operation of the rifle, said loading pull lever being supported by an axial bolt at a middle thereof, said loading pull lever being rotatable about said axial bolt, said loading pull lever having a second eyelet positioned beneath said trigger, said trigger suitable for receiving a human finger there against so as to fire a shot from said rifle;

a crescent-shaped portion positioned generally at a middle of said loading pull lever, said crescent-shaped portion positioned above said axial bolt, said crescent-shaped portion being an integral part of said loading pull lever, said crescent-shaped portion arranged so as to cover said trigger when said loading pull lever is rotated;

a pusher having a hook shape, said pusher being at an end of said loading pull lever ;

a piston positioned within said barrel, said piston being of a cylindrical shape, said pusher being cooperative with said piston so as to push said piston, said piston having a rod extending therefrom, said piston having a spring wrapped around said rod, said spring being compressible when said piston moves rearwardly;

a piston stopper having a rectangular plate connected to an end of said piston;

a hand-activated safety having a button of rectangular shape, said button having grooves on a surface thereof, said safety being positioned on an exterior of said firing mechanism, said safety being movable in one direction, said safety being returnable to an original position, said safety having a rectangular-shaped hole at a bottom thereof, said rectangular-shaped hole having a spring positioned there in, said bottom of said safety having an area of greater depth at a center thereof, said area being oval-shaped, said safety having a side hole into which a pin is placed;

a safety base positioned within said firing mechanism, said safety base being connected to said rectangular-shaped hole of said hand-activated safety, said safety base being a rectangular-shaped piece having a front end positioned in front of said piston stopper, said hand-activated safety having a stem sticking out from said safety base, said stem having a shank with an oval base, said stem corresponding to said spring positioned in said rectangular-shaped hole;

said trigger being a channeled member having a curved first elongated portion, said trigger extending into said firing mechanism, said trigger having a generally L-shape, said trigger having a second elongated portion having ends which define support legs for said hand-activated safety; and a retaining lever having a U-shaped plate with a hole at one end, said retaining lever positioned within the channel of said trigger, said retaining lever secured to said trigger with a pin, said U-shaped plate having a spring at an opposite end thereof so as to allow said lever to move to touch said piston stopper and to move downwardly to secure said rod of said piston.

2. The rifle of claim 1, said pusher being received in a groove of said piston, said pusher for pushing against said piston stopper.

3. The rifle of claim 1, said spring corresponding to said hole in said hand-activated safety being a resiliently flexed plate, said spring maintaining said hand-activated safety in a fixed and compressed position.

* * * * *